US006241696B1

(12) United States Patent
York

(10) Patent No.: US 6,241,696 B1
(45) Date of Patent: Jun. 5, 2001

(54) HAND HELD MASSAGE IMPLEMENT

(76) Inventor: Guy Warren York, P.O. Box 90931, Anchorage, AK (US) 99509

( * ) Notice: Subject to any disclaimer, the term of this patent is extended or adjusted under 35 U.S.C. 154(b) by 0 days.

(21) Appl. No.: 09/422,547

(22) Filed: Oct. 20, 1999

(51) Int. Cl.[7] ..... A61H 19/00
(52) U.S. Cl. ..... 601/137; 602/131
(58) Field of Search ..... 601/131, 132, 601/137, 129

(56) References Cited

U.S. PATENT DOCUMENTS

D. 408,925 * 4/1999 Berry et al. .
2,944,543 * 7/1960 Newcombe ..... 601/80
4,498,463 * 2/1985 Roming .
4,590,926 * 5/1986 Courtin .

FOREIGN PATENT DOCUMENTS

3527060 * 1/1987 (DE) .
2127297 * 4/1984 (GB) .
2194153A * 3/1988 (GB) .

* cited by examiner

*Primary Examiner*—Michael A. Brown
*Assistant Examiner*—Lalita M. Hamilton
(74) *Attorney, Agent, or Firm*—Michael J. Tavella

(57) ABSTRACT

A hand-held massage tool that has a number of rotating balls fitted into a grip. The balls are placed in sockets that permit them to rotate freely within the socket. This allows full omni-directional movement of the balls within the socket. The compartment is designed to hold only a portion of each ball. The remaining part of each ball rests above the massager body. The lower portion of the massager body curves downward forming an open center portion and a lower gripping surface. The lower gripping surface has a finger grip surface molded into the inner face of the lower gripping surface. Because the balls turn omni-directionally, there is no restriction on the movement of the device over the body. Moreover, there is no binding or abrasive rubbing caused by the balls not turning in a particular direction. Consequently, the device affords a comfortable, thorough massage.

20 Claims, 5 Drawing Sheets

HAND HELD MASSAGE IMPLEMENT

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to hand held massage implements and particularly to hand held massage implements having a number of omni-directional rotating balls.

2. Description of Related Art

Massage implements have been used for many years to work muscles in a number of ways. Most of these implements use a shaft or round object to work the muscles. Often, they have some type of handle. For the most part, these implements are effective, but do not provide the full extent of relief. Nor are they the most efficient design. Consequently, the person giving the massage becomes fatigued and the person receiving the massage does not receive the full benefits of it.

BRIEF SUMMARY OF THE INVENTION

The instant invention is a hand-held tool that has a number of rotating balls fitted into a grip. The balls are placed in sockets that permit them to rotate freely within the socket. This provides full omni-directional movement of the balls within the socket. The balls are fitted into sockets, or bearing pockets, at the top of the massager body. The massager body has a curved upper compartment into which the balls are placed. The compartment is designed to hold only a portion of each ball. The remaining part of each ball rests above the massager body. The lower portion of the massager body curves downward forming an open center portion and a lower gripping surface. The lower gripping surface has a finger grip surface molded into the inner face of the lower gripping surface. The device is used by passing a hand though the open center portion and gripping the finger grip surface. Then device is then brought against a person and pressed into place. The device is then moved about the person's body, allowing the balls to rub and turn against the person, thereby providing an effective massage.

Because the balls turn omni-directionally, there is no restriction on the movement of the device over the body. Moreover, there is no binding or abrasive rubbing caused by the balls not turning in a particular direction. Consequently, the device affords a comfortable, thorough massage.

DETAILED DESCRIPTION OF THE INVENTION

Figure 7:
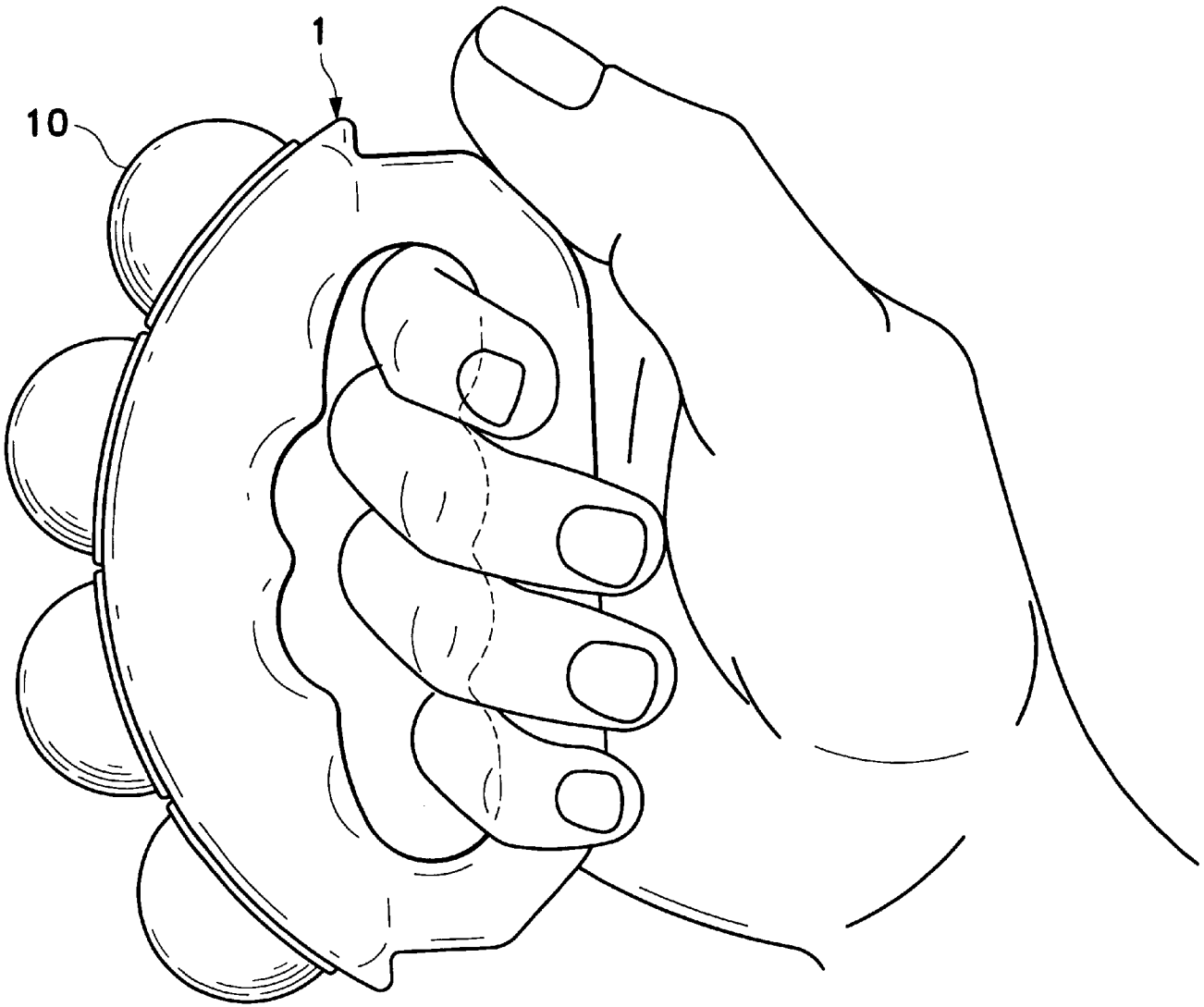
FIG. 7 is a side elevation view of the device being held in a hand.

Referring now to FIGS. 1, 2, 3, 4, and 5, the massage implement is shown. The device 1 has a molded housing 1*a* that has an upper portion 2 and a lower portion 3. The lower portion 3 and the upper portion 2 are not separate, but are molded as one piece in the preferred embodiment. The housing 1*a* is an ovular shape with an open center 4. The open center is designed to accommodate a hand 100 (see FIG. 7). The housing 1*a* is designed to allow either a left or a right hand to be inserted comfortably into the space 4. The lower portion 3 is formed with a number of finger grips 5 as shown. The upper portion 2 also has a number of grips 6. Note that this design permits a hand 100 to grip the device so that the massage balls 10 (discussed below) can be positioned outside the hand, above the knuckles, as shown in FIG. 7, or can be inverted so that the massage balls 10 are positioned "inside" the hand, or below the knuckles. This allows a lot of flexibility in use. When the massage balls 10 are placed above the knuckles, the user can reach part of the user's body, such as the legs, arms, back and feet, with ease. Moreover, the user can also work another person's body in a similar manner. With the massage balls inverted, a user can access other parts of the user's body, such as the head, neck and shoulders.

Figure 1:
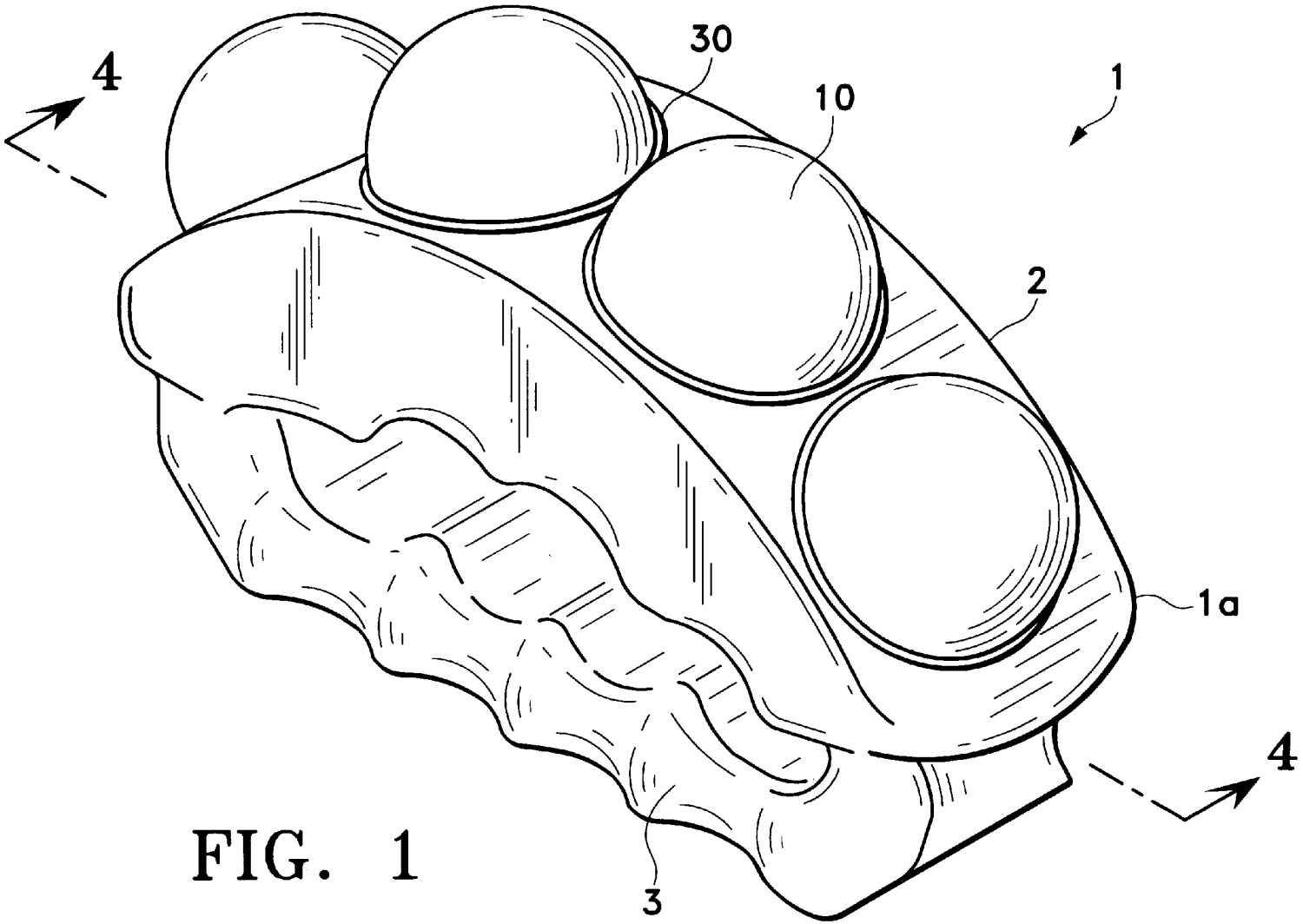
FIG. 1 is a perspective top view of the invention
Figure 3:
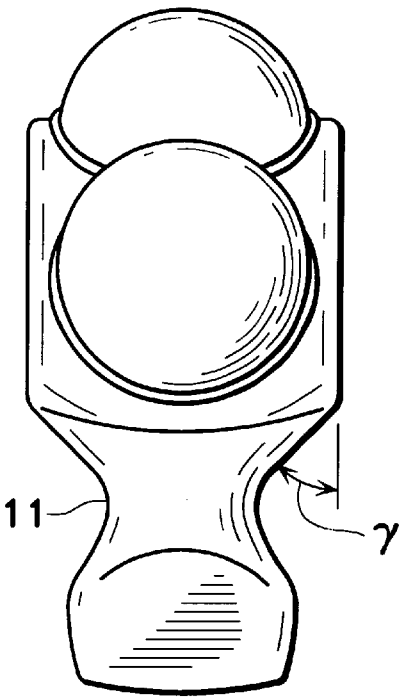
FIG. 3 is a side elevation view of the invention.

As shown in FIG. 3, then housing 1*a* has another feature that provides additional versatility. The lower portion 3 connects to the upper portion 2 at a narrow portion 11. The narrow portion 11 forms an angle $\gamma$ as shown in FIG. 3. In the preferred embodiment, the angle $\gamma$ is between 25 and 35 degrees, with the more preferred angle being about 28 degrees. The angle $\gamma$ and its relationship to the housing 1*a* allow the user to exert additional angular pressure on the patient form different directions with minimal effort. As shown in FIG. 7, for example, the user's thumb or forefinger can be positioned into the angular portion 11 and can then provide angular pressure by simply pushing against that spot.

Figure 2:
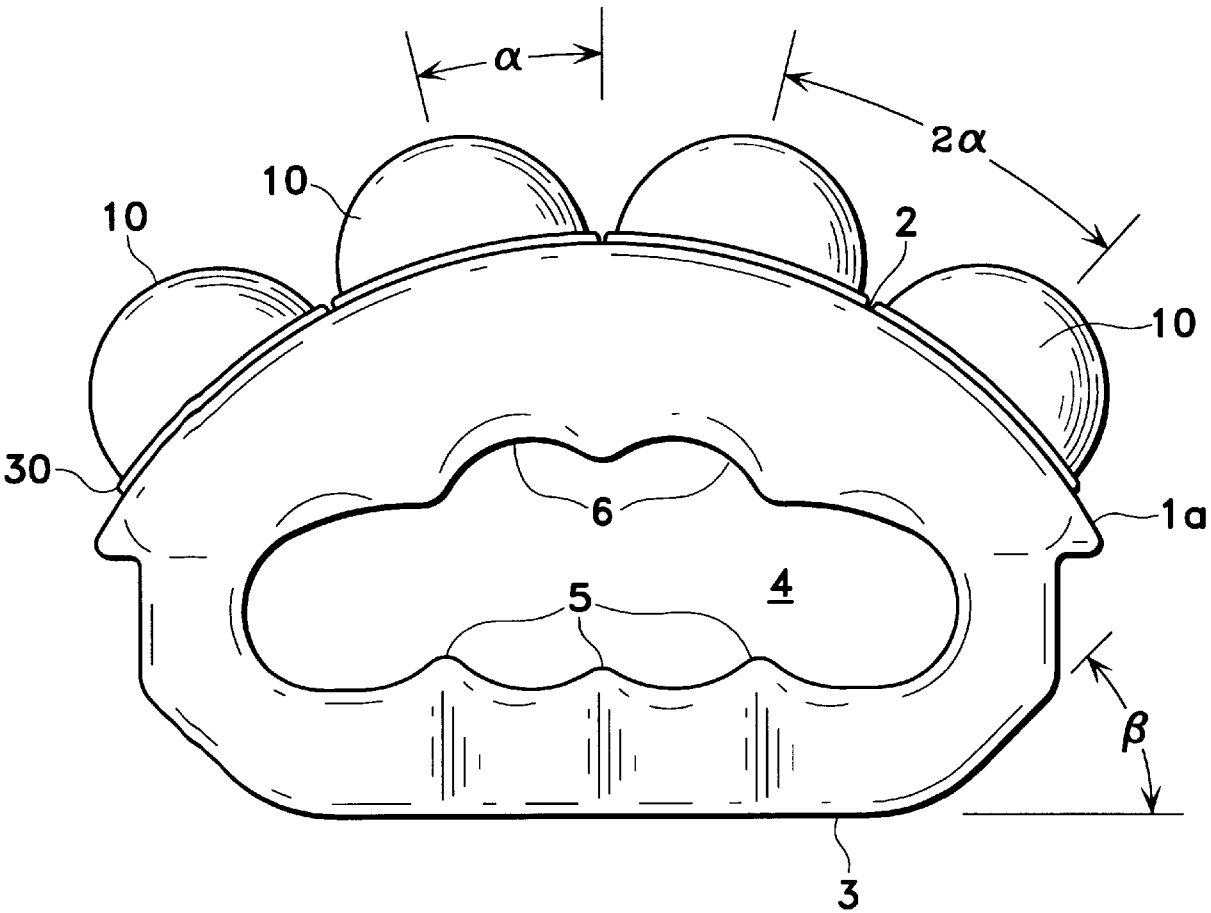
FIG. 2 is a front elevation view of the invention.

The lower portion 3 of the housing 1*a* is also angled at the bottom as shown in FIG. 2. This angle is designated as $\beta$. In the preferred embodiment, the angle $\beta$ is about 45 degrees. By positioning the user's hand against the angled portion, the user can exert additional or more oblique pressure on the patient.

Figure 5:
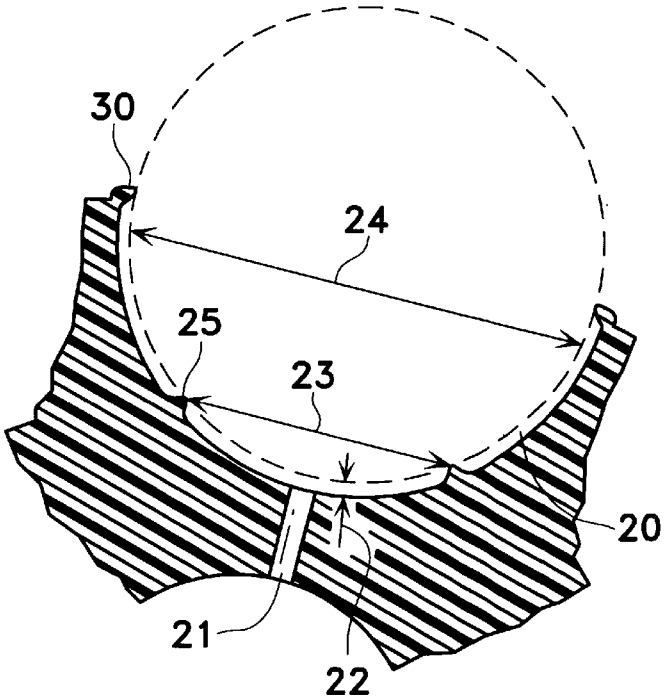
FIG. 5 is a detail view of a ball in a socket.
Figure 4:
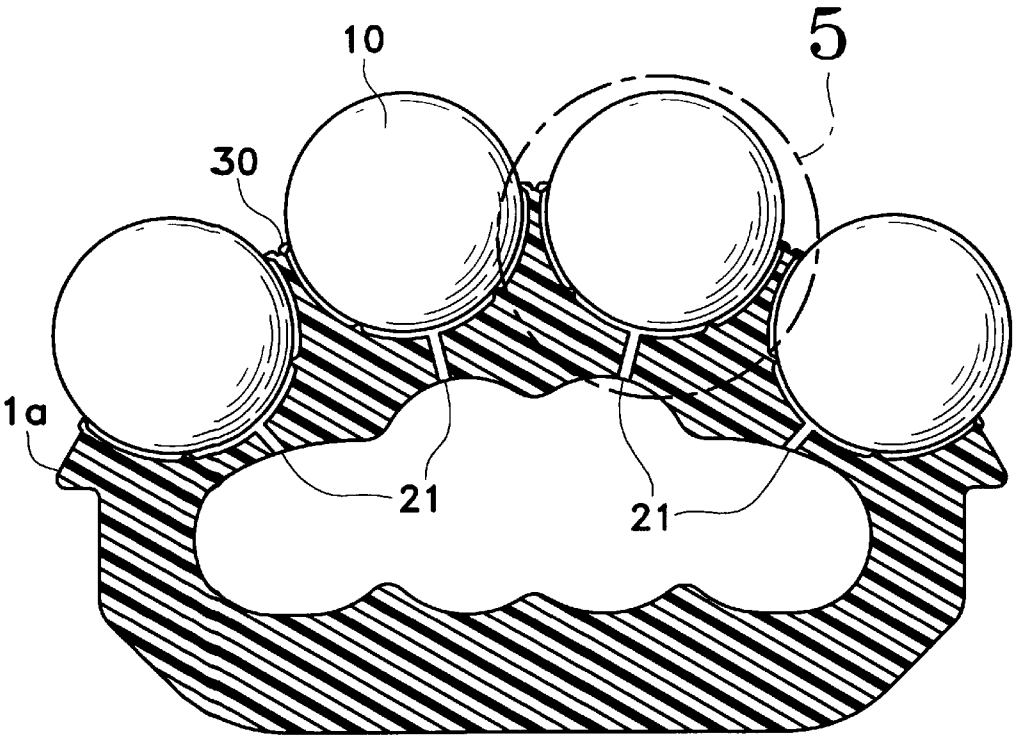
FIG. 4 is a cross-sectional view of the device taken along the lines 4—4 of FIG. 1.
Figure 6:
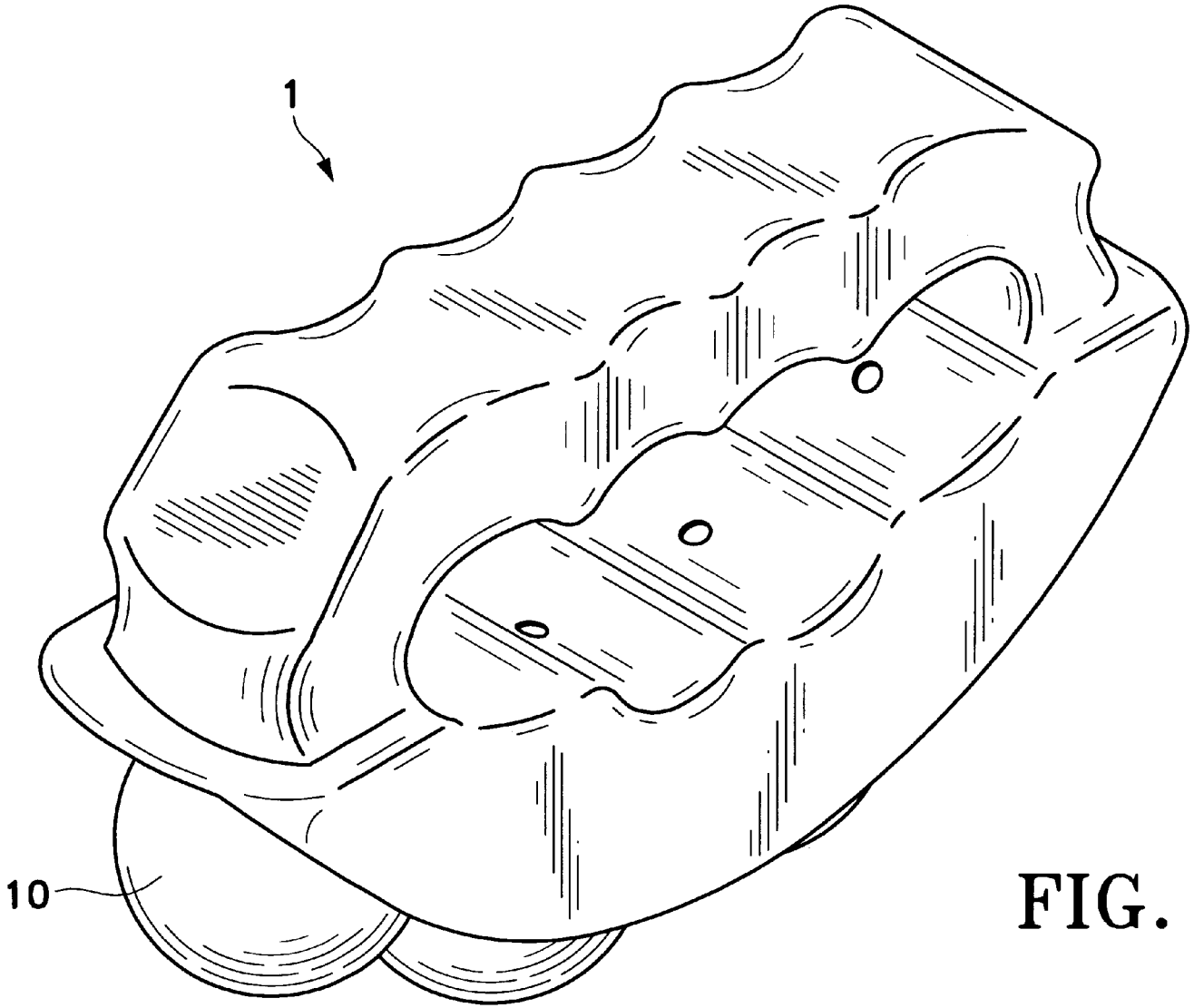
FIG. 6 is a perspective bottom view of the device.

Referring now to FIGS. 2, 3, 4, 5 and 6, details of the massage balls 10 and the mechanism for holding them is shown. As shown in FIG. 2, the preferred embodiment has four massage balls 10, forming an arc of about a 2¾-inch radius. The balls are set at an angle as shown in FIG. 2. In the preferred embodiment, angle $\alpha$ is between 13 and 14 degrees. The angle between ball centers is shown at $2\alpha$ or between 26 and 28 degrees. Referring now to FIGS. 4, 5, and 6, details of the sockets for mounting the balls 10 are shown. At the bottom of each socket 20 is a through hole 21 as shown. These through holes allow air to escape the socket 20 as the ball is pushed into the socket 20 during manufacture or ball replacement. This reduces the pressure need to push the ball into the socket. The through holes 21 also serve as access ports by which the ball can be pushed back out of the pocket by means of a push rod (not shown). Finally, the through holes 21 aid in the cleaning process by allowing fluids and small particles to be flushed from the sockets 21 during cleaning.

Above the through holes is a section of the socket that extends ¼ inch above the through hole. This section 22 is approximately 1 inch wide. This section is known as the lower clearance area. The clearance area allows the ball to rotate freely in all directions within the socket 20. Above the lower clearance area is the seat diameter 23. The seat diameter is where the ball rests in normal use. This diameter is approximately 1 inch for a ball 1.25 inches in diameter. Above the seat diameter is a second clearance area 24. A flange 25 further defines the seat diameter 23 and the second clearance area 24. This diameter is slightly larger than the ball to permit the ball to rotate in all directions while pivoting about the seat. In the preferred embodiment, this upper clearance area is 1.280 inches, for a ball 1.25 inches in diameter. This diameter extends upward from the seat location to a retainer flange 30. This distance is approximately 0.5 inches for a 1.25-inch ball. This flange 30 is shown in FIG. 5 and has an inside diameter slightly smaller than the diameter of the massage ball. This flange captures the ball in the socket and holds it in position.

The retainer flange can be constructed in many ways. The flange can be formed as an integral part of the housing 1*a* and socket in a resilient structure that allows a ball to be pressed into the socket and past the flange which then holds it in place. The flange can be formed of an expandable material such that when the material is heated, it expands to allow the ball to be inserted. Once cooled, the material shrinks to hold the ball in place. Another method uses a tool to push or roll the plastic at the mouth of the socket inward around the ball using both heat and pressure to fit the flange into position.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A massage implement comprising:

a) a housing, having an upper portion and a lower portion being fixedly attached, said upper portion and said lower portion of said housing forming a generally elliptical annular member having an open center, said open center forming a handhold;

b) a means for mounting a ball, formed within said upper portion; and c) at least one ball, said ball having a diameter, in said upper portion of said housing, whereby said ball is rotatably installed in said means for mounting a ball.

2. The massage implement of claim 1 wherein said open center of said housing as a plurality of indentations formed therein, said plurality of indentations corresponding to a user's knuckles when said housing is gripped by a user.

3. The massage implement of claim 1 wherein the means for mounting a ball comprise a socket formed in said housing.

4. The massage implement of claim 3 wherein said socket includes:

i) a bottom and a top;

ii) said bottom of said socket having a recessed portion, said recessed portion having a diameter less than the diameter of said ball;

iii) an upper chamber, said upper chamber having a diameter greater than the diameter of said ball; and iv) a retaining ring, formed at the top of said socket, whereby said retaining ring has an open inner diameter and where said open inner diameter of said retaining ring is less than the diameter of said ball.

5. The massage implement of claim 4 wherein said socket further comprises a through hole formed in the bottom of said socket.

6. A massage implement comprising:

a) a housing, having an upper portion and a lower portion being fixedly attached, said upper portion and said lower portion of said housing forming a generally elliptical annular member having an open center, said open center forming a handhold;

b) a plurality of sockets, formed within said upper portion, to receive a plurality of balls;

c) a plurality of balls, each ball having a diameter, rotatably installed within said plurality of sockets; and d) a means for retaining said plurality of balls in said plurality of sockets.

7. The massage implement of claim 6 wherein each socket includes:

i) a bottom and a top;

ii) said bottom of each socket having a recessed portion, said recessed portion having a diameter less than the diameter of each of said plurality of balls; and iii) an upper chamber, said upper chamber having a diameter greater than the diameter of each of said plurality of balls.

8. The massage implement of claim 6 wherein each of said plurality of sockets has a top, and further wherein said means for retaining said plurality of balls in said plurality of sockets comprises a plurality of retaining rings, whereby one retaining ring being formed at the top of each of said plurality of sockets, and further whereby each retaining ring has an open inner diameter and where said open inner diameter of each retaining ring is less than the diameter of each of said plurality of balls.

9. The massage implement of claim 8 wherein each socket has a bottom and wherein each socket further comprises a through hole formed in the bottom of each socket.

10. The massage implement of claim 6 wherein the upper portion of said housing has a bottom, and further wherein the bottom of said upper portion has a plurality of indentations formed therein, said plurality of indentations corresponding to a user's knuckles when said housing is gripped by a user.

11. The massage implement of claim 6 wherein the lower portion of said housing further comprising a plurality of indentations, said plurality of indentations corresponding to a user's fingers when said lower portion of said housing is gripped by a user.

12. The massage implement of claim 6 wherein said lower portion has two ends, and further wherein each of the two ends of said lower portion forms an angle with respect to a line parallel to the lower portion.

13. The massage implement of claim 12 wherein the angle formed by each of the two ends of said lower housing is about 45 degrees.

14. The massage implement of claim 6 wherein the lower portion of said housing and the upper portion of said housing have a tapered portion when viewed on a longitudinal axis with respect to said housing.

15. The massage implement of claim 14 wherein the tapered portion of said upper portion forms an angle with respect to a perpendicular line drawn through said longitudinal axis.

16. The massage implement of claim 15 wherein the angle formed angle with respect to a perpendicular line drawn through said longitudinal axis is between about 25 and 35 degrees.

17. The massage implement of claim 6 wherein the upper portion has a top, and further wherein said top of said upper portion is curved, forming an arc.

18. The massage implement of claim 17 wherein the plurality of balls is set in an angular placement along said arc of said upper portion.

19. The massage implement of claim 18 wherein each of said plurality of balls has a center axis, and further wherein an angle formed between the center axis of each ball and a line normal to the top of said arc is between 13-and 14 degrees.

20. The massage implement of claim 19 wherein an angle formed between the center axis of one ball and the center axis of an adjacent ball is between about 26–28 degrees.

* * * * *